United States Patent [19]

Alread

[11] Patent Number: 5,004,231

[45] Date of Patent: Apr. 2, 1991

[54] EXERCISE GLOVE

[76] Inventor: Don Alread, 11960 SW. 12th St., Pembroke Pines, Fla. 33025

[21] Appl. No.: 485,032

[22] Filed: Feb. 26, 1990

[51] Int. Cl.[5] ..... A63B 21/00

[52] U.S. Cl. ..... 272/143; 272/119; 272/123; 2/161 A

[58] Field of Search ..... 272/67, 119, 117, 122, 272/123, 143, 109; 2/159, 161 R, 161 A

[56] References Cited

U.S. PATENT DOCUMENTS

| | | | |
|---|---|---|---|
| 4,484,740 | 11/1984 | Green | 272/119 |
| 4,546,495 | 10/1985 | Castillo | 272/119 X |
| 4,698,850 | 10/1987 | Patton, Sr. et al. | 2/161 A X |
| 4,750,218 | 6/1988 | Ziegler | 2/161 R X |
| 4,793,005 | 12/1988 | Hetzel, Jr. | 272/123 X |
| 4,807,876 | 2/1989 | Lothar | 272/123 |
| 4,827,535 | 5/1989 | Socey | 272/123 X |
| 4,905,321 | 3/1990 | Walunga | 2/161 A |

FOREIGN PATENT DOCUMENTS

| | | | |
|---|---|---|---|
| 116670 | 8/1984 | European Pat. Off. | 272/119 |
| 217608 | 1/1910 | Fed. Rep. of Germany | 272/119 |

*Primary Examiner*—Robert Bahr

*Attorney, Agent, or Firm*—Leon Gilden

[57] ABSTRACT

Apparatus including a glove member formed with a reinforced palm surface underlieing a top surface for association of the back of the hand wherein a reinforcing web is mounted overlying the four finger sockets of the glove. A wrist strap is securable to enclose an individual's wrist directed within the glove, and a loop member and a free strap are secured to opposed ends of the wrist strap member to provide an encompassing strap for securement about associated exercise bars. Modifications of the instant invention include finger pockets securable overlying the finger sockets and thumb socket with modifications of the pockets utlizing fluid filled cushions. Weighted bars are optionally securable within pockets formed within free ends of each of the thumb and finger sockets.

8 Claims, 5 Drawing Sheets

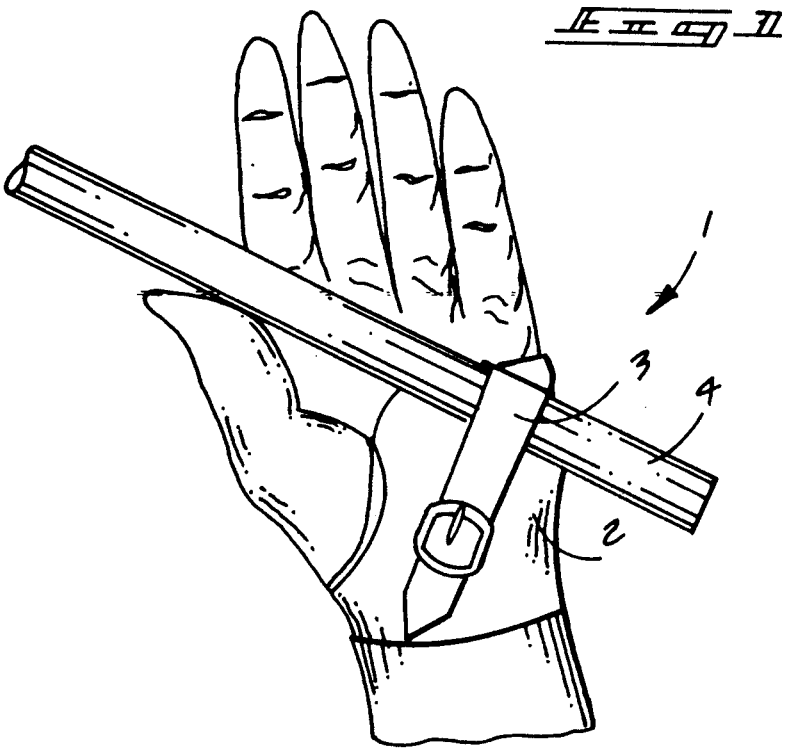
PRIOR ART
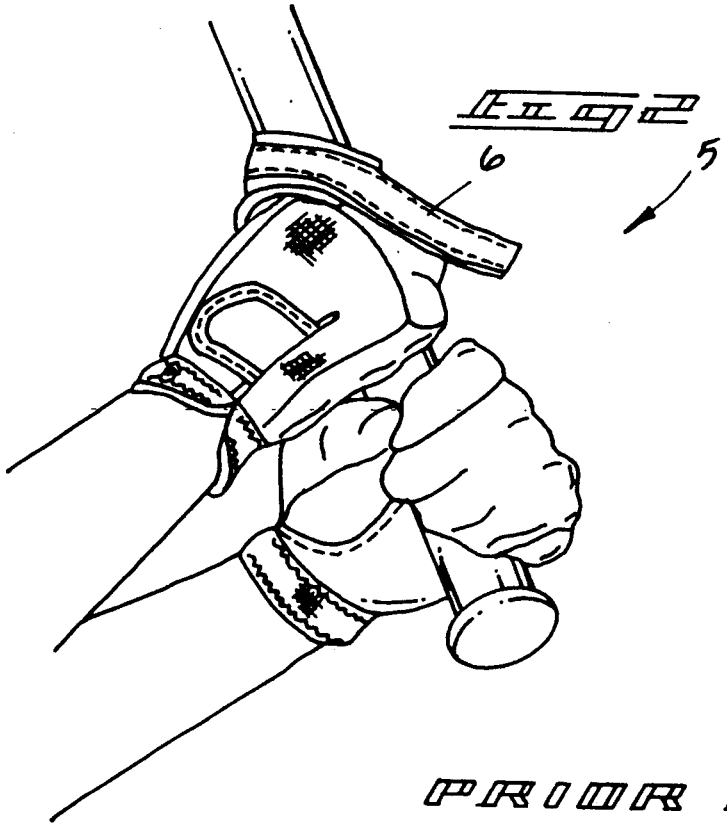
PRIOR ART

EXERCISE GLOVE

BACKGROUND OF THE INVENTION

1. Field of the Invention

The field of the invention relates to exercise glove organizations, and more particularly pertains to a new and improved exercise glove wherein the same provides a loop and strap member fixedly mounted overlying the palm surface of each glove of a glove pair in association with various exercise accessories.

2. Description of the Prior Art

The use of glove exercise apparatus for application to varying sport conditions is known in the prior art. Heretofore for individuals engaged in weight training, a glove organization has heretofore not been provided to provide a strap pair for use in securement about various bars during a exercising event. Examples of the prior art include U.S. Pat. No. 1,681,389 to BLAKE wherein a golf glove includes a strap and buckle mounted to a palm surface of the glove to receive and position a golf club therewithin.

U.S. Pat. No. 4,700,405 to STERNBERG provides a baseball batting glove wherein a loop member is securable to overlie and secure a baseball bat during a batting event.

U.S. Pat. No. 1,173,971 to HUNTER provides a hand covering type glove formed with a single loop directed about a palm surface of the glove for use in carpentry procedures.

U.S. Pat. No. 3,381,304 to COCO provides for a hand guard for use by gymnastic individuals wherein the guard is a flexible strap member to be wrapped to and overlie the palm surface of an individual gymnast.

U.S. Pat. No. 2,877,465 to STROUD provides a golf glove formed with a generally U-shaped hook element to mount and position a golf club in a predetermined orientation relative to a palm surface of the glove.

As such, it may be appreciated that there continues to be a need for a new and improved exercise glove wherein the same addresses both the problems of ease of use and effectiveness in permitting individuals to fixedly grasp exercise bars, and in this respect, the present invention substantially fulfills this need.

SUMMARY OF THE INVENTION

In view of the foregoing disadvantages inherent in the known types of exercise gloves now present in the prior art, the present invention provides an improved exercise glove wherein the same utilizes a loop directed through a free strap wherein the loop and free strap are directed from opposed sides of an interior surface of the wrist to properly position and orient an exercise bar relative to the palm surface of an individual utilizing the glove to arrange the bar for balance and securement. As such, the general purpose of the present invention, which will be described subsequently in greater detail, is to provide a new and improved exercise glove which has all the advantages of the prior art exercise glove constructions and none of the disadvantages.

To attain this, the exercise glove of the instant invention includes an apparatus with a glove member formed with a reinforced palm surface underlieing a top surface for association of the back of the hand wherein a reinforcing web is mounted overlieing the four finger sockets of the glove. A wrist strap is securable to enclose an individual's wrist directed within the glove, and a loop member and a free strap are secured to opposed ends of the wrist strap member to provide an encompassing strap for securement about associated exercise bars. Modifications of the instant invention include finger pockets securable overlying the finger sockets and thumb socket with modifications of the pockets utilizing fluid filled cushions. Weighted bars are optionally securable within pockets formed within free ends of each of the thumb and finger sockets. There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the awrt will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved exercise glove which has all the advantages of the prior art exercise glove and none of the disadvantages.

It is another object of the present invention to provide a new and improved exercise glove which may be easily and efficiently manufactured and marketed.

It is a further object of the present invention to provide a new and improved exercise glove which is of a durable and reliable construction.

An even further object of the present invention is to provide a new and improved exercise glove which is susceptible of a low cost of manufacture with regard to both materials and labor, and which accordingly is then susceptible of low prices of sale to the consuming public, thereby making such exercise glove apparatuses economically available to the buying public.

Still yet another object of the present invention is to provide a new and improved exercise glove which provides in the apparatuses and methods of the prior art some of the advantages thereof, while simultaneously overcoming some of the disadvantages normally associated therewith.

Still another object of the present invention is to provide a new and improved exercise glove which may be compactly stored when not being utilized.

Yet another object of the present invention is to provide a new and improved exercise glove utilizing a loop and strap respectively directed from opposed side portions of a wrist area of the glove to present an inner section of the wrist and loop to properly orient a bore engaged by free strap of the organization relative to a palm surface of the glove.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is an orthographic view taken elevation of a prior art exercise glove.

FIG. 2 is an isometric illustration of a further example of an exercise glove as set forth in the prior art.

DESCRIPTION OF THE PREFERRED EMBODIMENT

Figure 3:
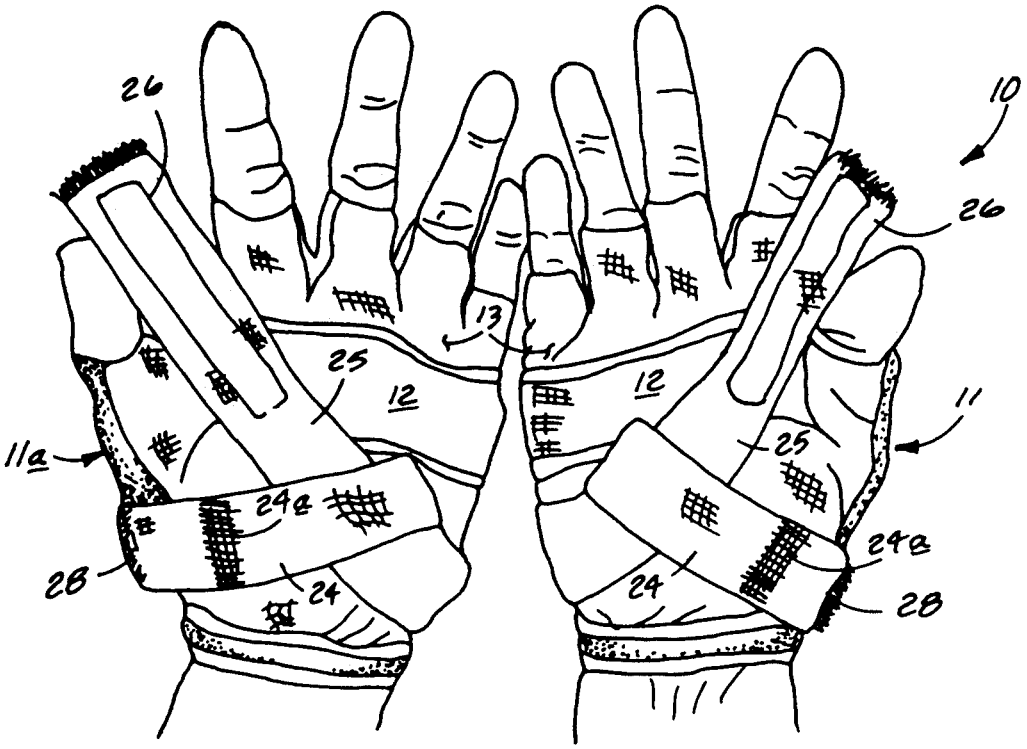
FIG. 3 is an orthographic view taken in elevation of the instant invention.

With reference now to the drawings, and in particular to FIGS. 1 to 10 thereof, a new and improved exercise glove embodying the principles and concepts of the present invention and generally designated by the reference numerals 10, 10*a*, 10*b*, and 10*c*.

Reference to FIG. 1 illustrates a golf glove 1 utilizing a glove member 2 with a strap 3 directed diagonally relative to a palm surface of the glove to secure a golf club 4 therewithin. FIG. 2 illustrates a prior art baseball glove pair 5, wherein an upper glove utilizes an encompassing strap 6 to secure a baseball bat relative to the glove arrangement.

Figure 4:
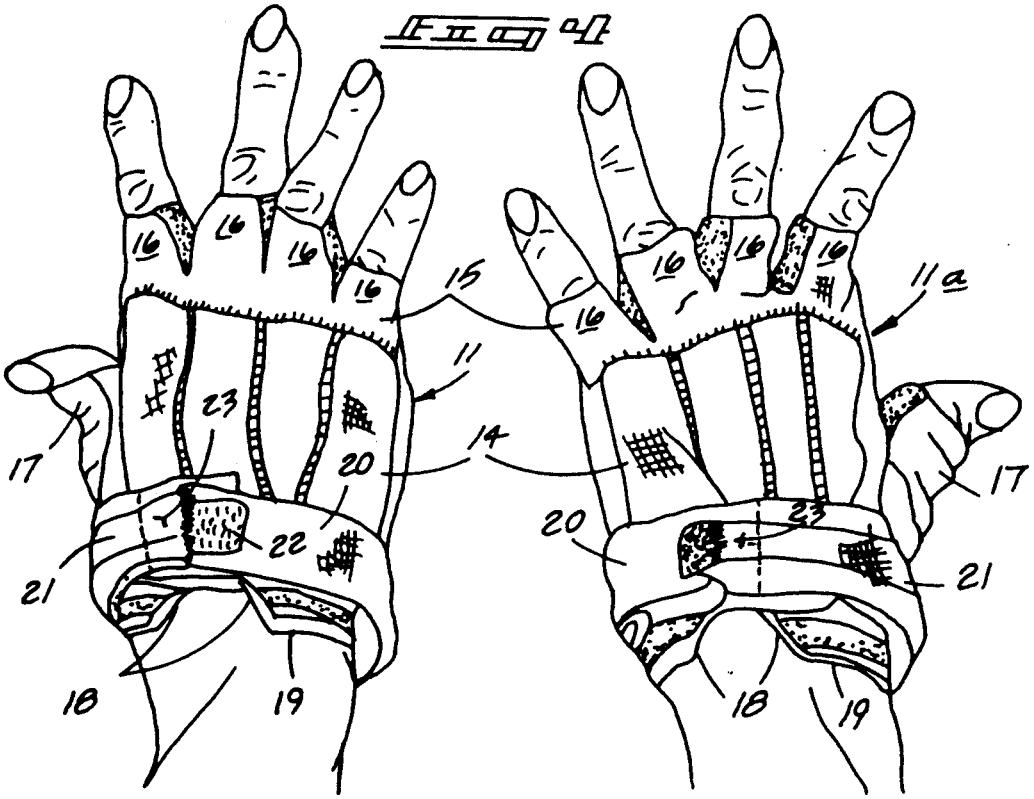
FIG. 4 is a rear orthographic view taken in elevation of the instant invention.
Figure 5:
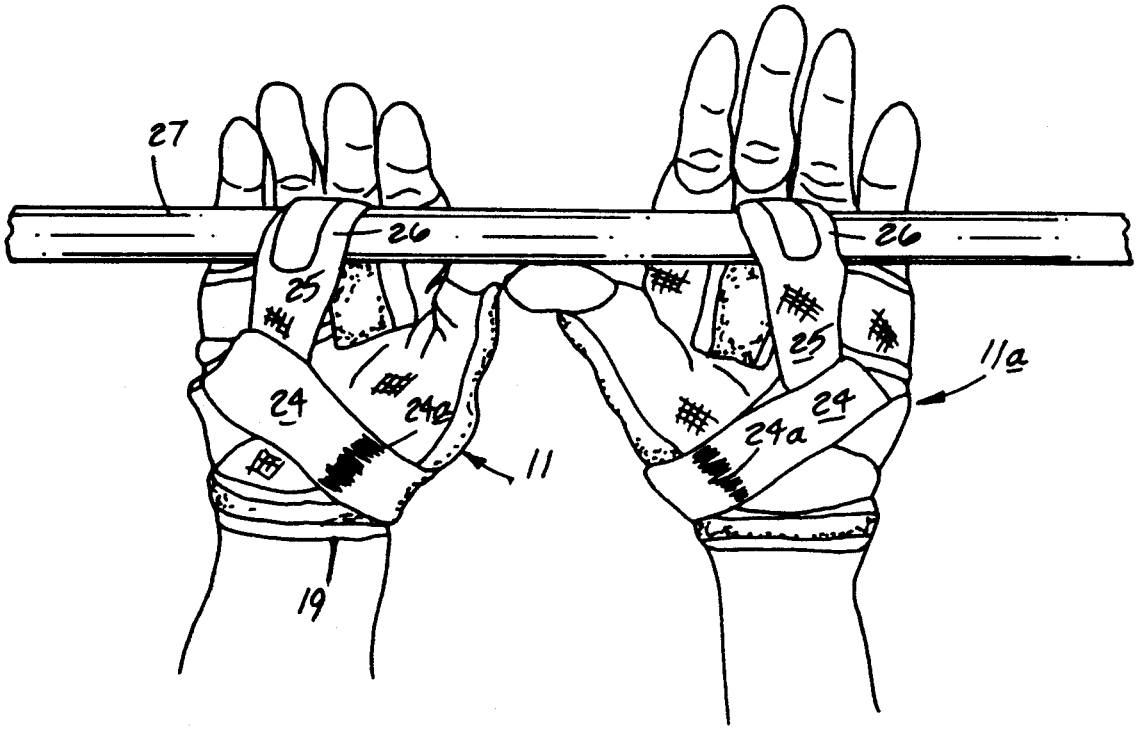
FIG. 5 is an orthographic view taken in elevation of the gloves of the instant invention positioned about an exercise bar.
Figure 6:
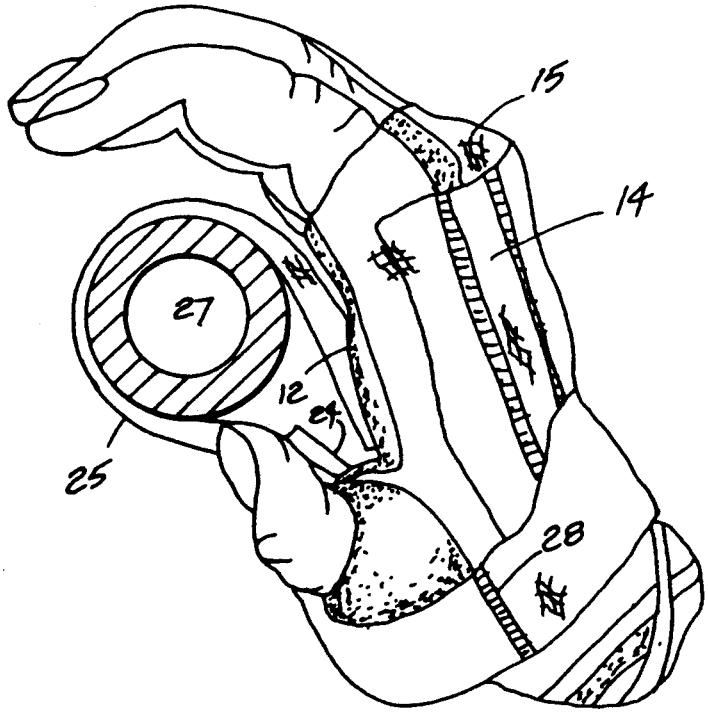
FIG. 6 is an orthographic side view taken in elevation of the glove arrangement of the instant invention secured about the bar as illustrated in FIG. 5.

More specifically, the exercise glove 10 of the instant invention essentially comprises a right glove 11 in association with a left glove 11*a* to define a glove pair. Each glove of the glove pair are typically of a mirror image construction relative to one another wherein various components of each are identical in configuration and relationship, and accordingly description of only one of the glove members of the glove pair is set forth as such description applies to both glove members. Each glove includes a reinforced palm web surface 12 defined by a plural layer surface overlieing and mounted above the surface layer 13 defining the base material utilized in construction of the glove. The back surface 14 of the glove includes a series of finger sockets 16 extending forwardly thereof as well as a thumb socket 17 arranged in a typical glove-like arrangement for use about an individuals hand. The finger sockets include a reinforced web 15 directed thereover overlying the back surface 14 as illustrated in FIG. 4 to provide reinforcement thereof to effect enhanced integrity of the finger socket configuration. The reinforcement does not extend to the interior surface of the finger sockets to maintain flexibility of the sockets in a grasping procedure in use of the gloves.

Each glove is defined by a wrist entrance discontinuous edge 19 defining a split web portion 18 oriented in alignment with the back surface of each glove. A first wrist strap 20 cooperates with a second wrist strap 21 directed from opposed sides of the split web portion 18 to overlie and secure the glove about a wrist of an individual. A respective first hook loop fastener patch 22 is cooperative with a second hook loop fastener patch 23 mounted upon confronting free terminal end surfaces of the first and second wrist straps 20 and 21.

A flexible palm loop strap 24 includes a first loop seam 24*a* to define the loop 24 and includes a second loop seam 28 to secure the loop strap 24 to a terminal end the second wrist strap 21 in an aligned relationship therewith. The loop of the loop strap 24 receives an elongate flexible strap 25 therethrough that is in turn seamed to a further terminal end of the first wrist strap 20 in an aligned relationship thereto. A reinforcing rectangular seam 28 is formed through the flexible strap 25 originating at a free end thereof and extending interiorly along the length of the strap to provide prolonged life of the flexible strap due to its continuous contact with a surface to be engaged. Such a surface is illustrated, in FIGS. 5 and 6 for example, as exercise bar 27. The loop strap 24 directs and positions the flexible strap 25 in a medial orientation relative to the palm surface of each glove and thereby further distributes tension directed from engagement and a pulling of the exercise bar to each side surface of the wrist to distribute tension from a hard griping by the fingers of an individual and properly distribute such tension to each side of the hand during a weight training procedure.

Figure 7:
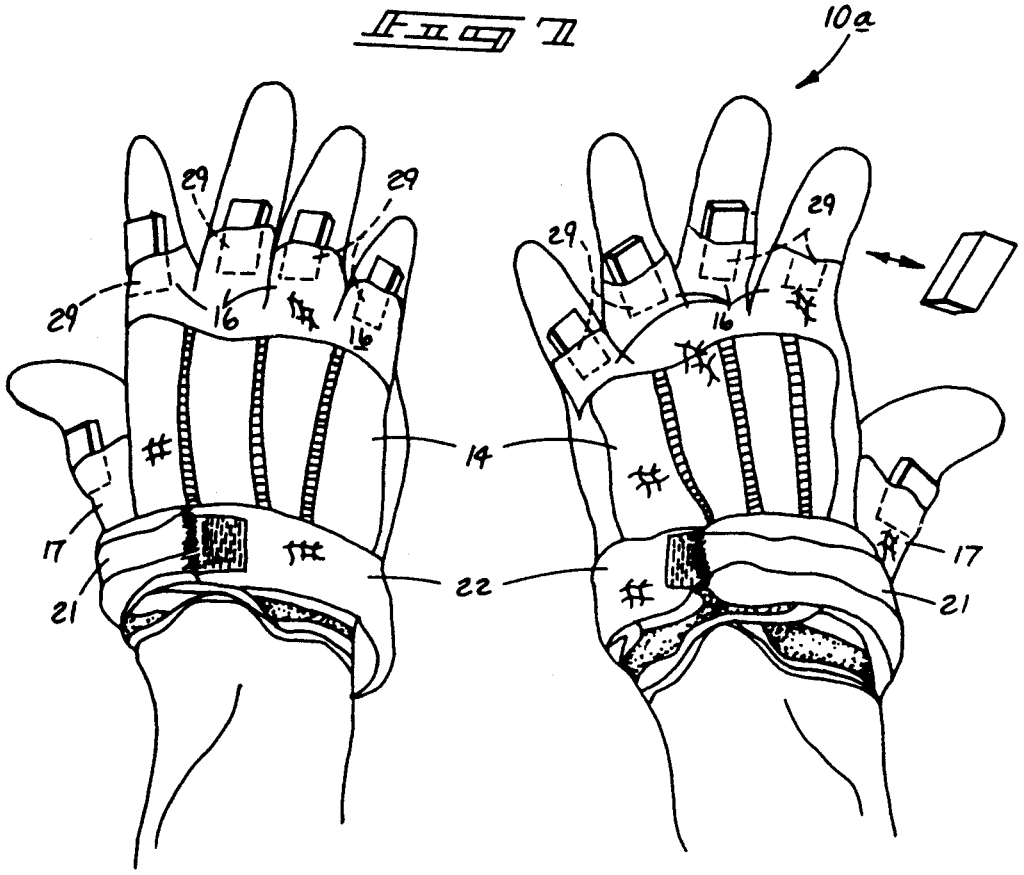
FIG. 7 is an orthographic view taken in elevation of a modified exercise glove of the instant invention.

FIG. 7 illustrates a modified glove utilizing finger pockets 29 formed through top surfaces of each of the finger and thumb sockets to receive weighted bars 30 therewithin to enhance exercise of an individual in a non-weight training forum such as in running and the like, and to provide enhanced weight training resistance. The pockets originate from free ends of each of the sockets to receive the weighted bars therewithin as illustrated in FIG. 7.

Figure 8:
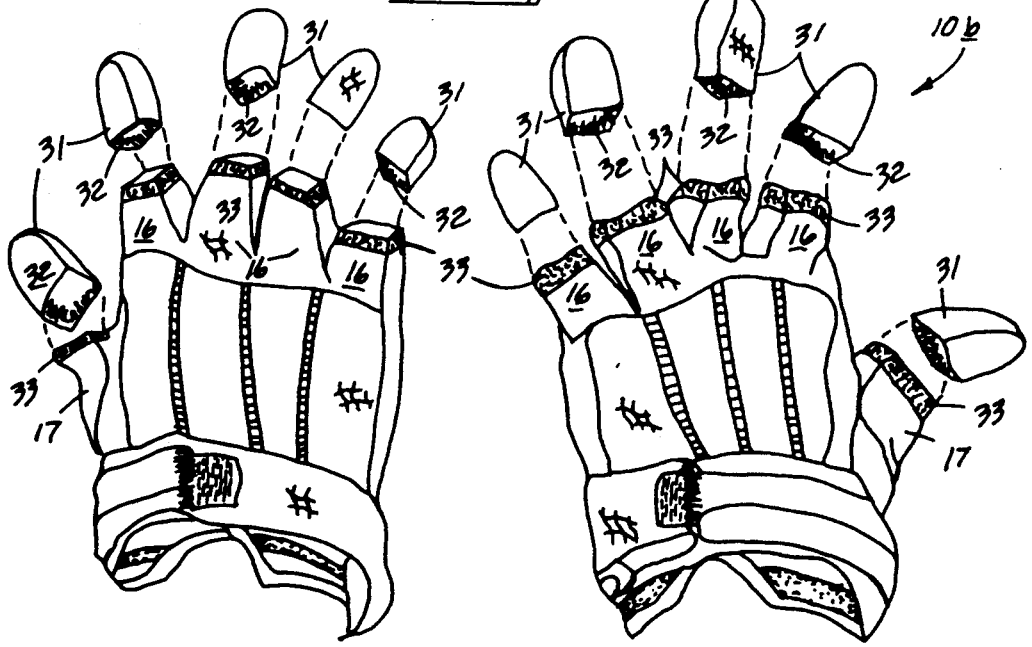
FIG. 8 is an isometric illustration of a further modified exercise glove of the instant invention.

FIG. 8 illustrates a further modified glove arrangement 10*b* wherein weighed finger and thumb covers 31 are securable to free terminal ends of each of the thumb and finger sockets 17 and 16 respectively. The covers 31 include interior hook and loop encircling surfaces 32 cooperative with exterior encircling hook and loop surfaces 33 formed about each terminal free end surface of each of the thumb and finger socket as illustrated in FIG. 8.

Figure 9:
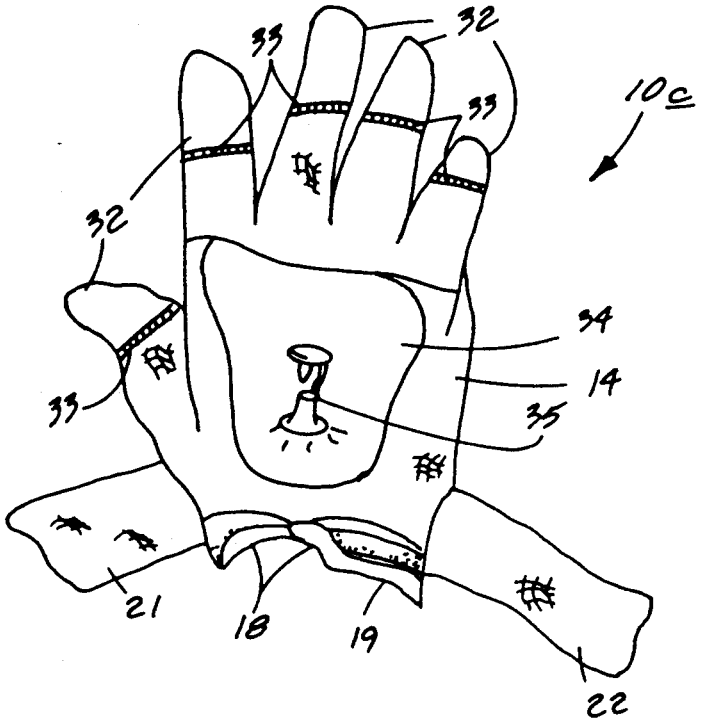
FIG. 9 is an orthographic rear view taken in elevation of a yet further modified glove of the instant invention.

FIG. 9 illustrates a yet further modified glove arrangement C including a pocket 34 integrally mounted to the back surface 14 of the glove including a valve 35 to enable directing of air or fluid within the pocket to provide a cushioning surface to the back surface of an individuals hand to provide a contra force against the back surface of the hand to minimize displacement of the hand during a grasping procedure in a weight training program.

Figure 10:
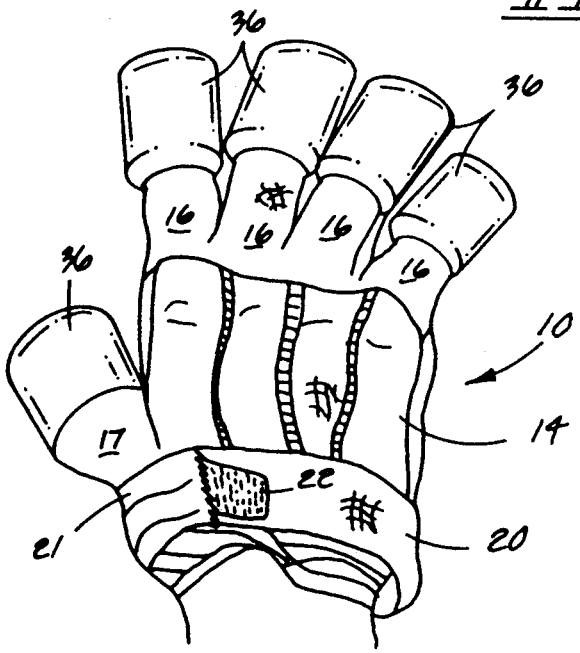
FIG. 10 is an isometric illustration of the instant invention in association with cushioned finger pockets.

FIG. 10 illustrates the glove 10 utilizing a series of fluid or air filled finger pockets 36 insertable over free ends of the fingers and over free ends of each of the thumb and finger sockets 17 and 16 respectively to provide cushioning of the fingers and thumb.

As to the manner of usage and operation of the instant invention, the same should be apparent from the above disclosure and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. An exercise glove comprising, a back web surface overlying a palm web surface wherein the glove further includes four finger sockets and a thumb socket integrally mounted to the back and palm web surfaces wherein each socket includes a through-extending aligned opening directed through each of the sockets to an interior cavity defined by the glove wherein each of the thumb and finger sockets includes a free forward annular terminal edge, and a lower terminal end of the glove includes a discontinuous wrist engaging edge with a split web directed into the back surface from the wrist engaging edge, and a first flexible strap and a second flexible strap selectively securable together overlying the split web wherein each first and second strap include engagement means for securing the first and second straps together, and further including a loop strap defining a loop diagonally overlying the palm web surface and terminating medially thereof and secured at its lower terminal end to a rear terminal end of the second strap, and an elongate flexible strap directed through the loop and secured at its rear terminal end to a rear terminal end of the first flexible strap.

2. A glove as set forth in claim 1 wherein the elongate flexible strap includes an elongate rectangular seam directed through the elongate flexible strap adjacent its free terminal end spaced from its lower terminal end for providing reinforced integrity of the elongate flexible strap.

3. A glove as set forth in claim 2 wherein each free forward annular terminal edge of each finger and thumb socket includes an exterior encircling hook loop fastener surface defining each free forward annular terminal edge, and further including a finger pocket member securable to each exterior encircling hook loop fastener surface wherein each pocket member includes an interior hook loop fastener surface adjacent an opening of each pocket member for securement to the exterior hook loop fastener surface of each finger and thumb socket.

4. A glove as set forth in claim 3 wherein each of the finger pockets include weighted members secured within each finger pocket surface.

5. A glove as set forth in claim 3 wherein each of the pockets includes a fluid filled pocket thereabout to define a cushion surface for use with the glove.

6. A glove as set forth in claim 5 wherein the back web surface includes a pocket member integrally mounted thereon, the pocket member including a valve directed therethrough for filling the pocket member with a fluid.

7. Apparatus set forth in claim 2 wherein each free forward annular terminal edge includes a pocket therewithin, each pocket receiving a weighted bar therewithin.

8. A glove as set forth in claim 6 wherein the palm web surface of the glove includes a reinforcing layer coextensive therewith, and the back web surface includes a single reinforcing web mounted forwardly of the back web surface overlieing and coextensive with each finger socket.

* * * * *